US006726342B1

(12) United States Patent
Lai

(10) Patent No.: US 6,726,342 B1
(45) Date of Patent: Apr. 27, 2004

(54) FLASHLIGHT

(75) Inventor: Larry Lai, Tai Bao (TW)

(73) Assignee: Plum Industrial Co., Ltd. (TW)

( * ) Notice: Subject to any disclaimer, the term of this patent is extended or adjusted under 35 U.S.C. 154(b) by 0 days.

(21) Appl. No.: 10/303,744

(22) Filed: Nov. 26, 2002

(51) Int. Cl.[7] ..... F21L 4/04

(52) U.S. Cl. ..... 362/188; 362/187; 362/202; 362/203; 362/285; 362/372

(58) Field of Search ..... 362/187, 188, 362/197, 198, 202, 203, 208, 285, 306, 372

(56) References Cited

U.S. PATENT DOCUMENTS 2,516,993 A * 8/1950 Holt ..... 362/188
4,388,673 A * 6/1983 Maglica ..... 362/183
4,949,231 A * 8/1990 Wang ..... 362/206
4,967,325 A * 10/1990 Shiau ..... 362/188
4,987,523 A * 1/1991 Lindabury et al. ..... 362/188
5,006,969 A 4/1991 Lai
5,171,086 A * 12/1992 Baloochi ..... 362/188
5,400,227 A * 3/1995 Maglica et al. ..... 362/206
5,461,552 A * 10/1995 Tillery ..... 362/188

* cited by examiner

*Primary Examiner*—Stephen Husan
*Assistant Examiner*—Hargobind S. Sawhney
(74) *Attorney, Agent, or Firm*—Stites & Harbison PLLC; Marvin Petry

(57) ABSTRACT

A flashlight comprises a barrel, a lamp shield assembly, and a lamp seat assembly. The lamp seat assembly includes a lamp seat, a movable seat, and a lamp mounted on the movable seat. The position of the movable seat in the lamp seat can be adjusted to locate the filament of the lamp in the focus of the reflective member of the lamp shield assembly so that the light beams emitted from the lamp can travel a long distance.

6 Claims, 4 Drawing Sheets

FLASHLIGHT

BACKGROUND OF THE INVENTION

1. Field of the Invention

The present invention relates to a flashlight allowing adjustment of a filament of a lamp to a focus of a reflective member so that the light beams emitted from the lamp can travel a long distance.

2. Description of the Related Art

U.S. Pat. No. 5,006,969 discloses a flashlight comprising a conductive cylinder, a bulb threadedly engaged in a front end of the conductive cylinder, a light-shell threadedly engaged with an outer threading on the front end of the conductive cylinder, and a light condenser mounted in the light-cell. The bulb is mounted to a position in front of or behind a hole of the light condenser. For a qualified bulb, the filament 2' of he bulb held by two supports 1' should be parallel to a top face of an insulating member 3', as illustrated in FIG. 1 of the drawings. When the filament of the bulb is not located in the focus of the light condenser, the bulb can be moved along a longitudinal direction of the barrel by means of turning the light-shell until the filament of the bulb is moved to the focus of the light condenser, as shown in FIG. 2. Thus, the light beams emitted from the bulb may travel a long distance. However, as illustrated in FIGS. 3A and 3B, in a case that the filament 2' of the bulb is not parallel to the top face of the insulating member 3', it is impossible to locate the filament 2' of the bulb in the focus of the light condenser. As a result, the light beams emitted from the bulb could not travel far.

SUMMARY OF THE INVENTION

It is the primary object of the present invention to provide a flashlight allowing adjustment of a filament of a lamp to a focus of a reflective member so that the light beams emitted from the lamp can travel a long distance.

A flashlight in accordance with the present invention comprises a barrel, a lamp shield assembly, and a lamp seat assembly. The lamp seat assembly includes a lamp seat, a movable seat, and a lamp mounted on the movable seat. The position of the movable seat in the lamp seat can be adjusted to locate the filament of the lamp in the focus of the reflective member of the lamp shield assembly so that the light beams emitted from the lamp can travel a long distance.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
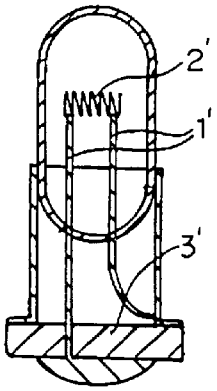
FIG. 1 PRIOR ART
FIG. 1 is a sectional view of a conventional bulb.
Figure 2:
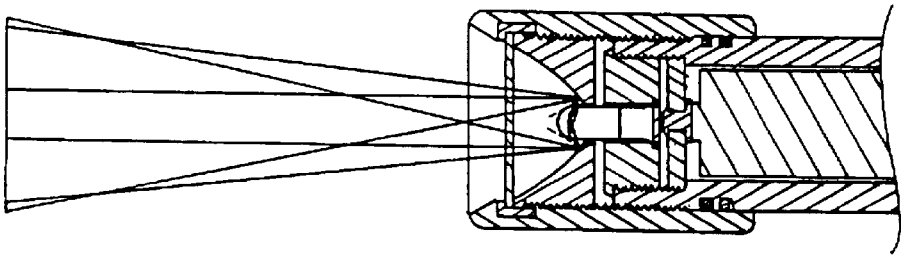
FIG. 2 PRIOR ART
FIG. 2 is a sectional view of a flashlight with a conventional bulb in FIG. 1.
Figure 3A:
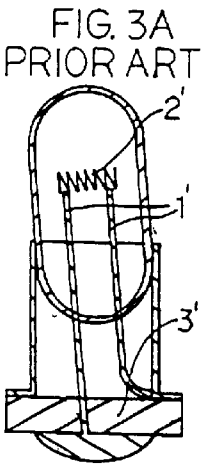
FIG. 3A PRIOR ART
FIGS. 3A and 3B are sectional views illustrating conventional bulbs with a tilted filament.
Figure 3B:
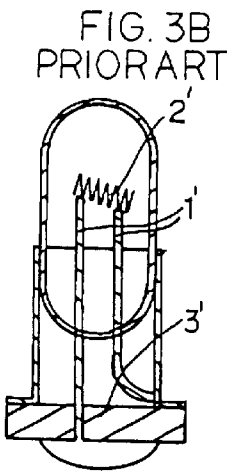
FIG. 3B PRIOR ART
Figure 4:
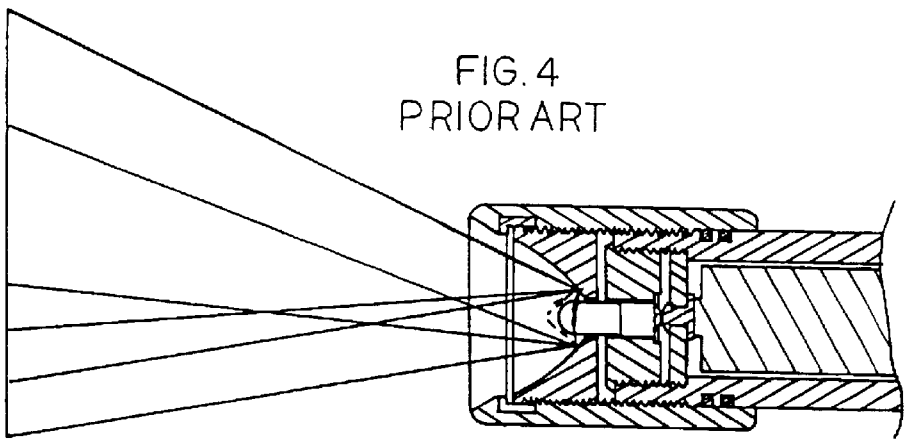
FIG. 4 PRIOR ART
FIG. 4 is a sectional view illustrating illumination of a flashlight having a bulb with a tilted filament.
Figure 5:
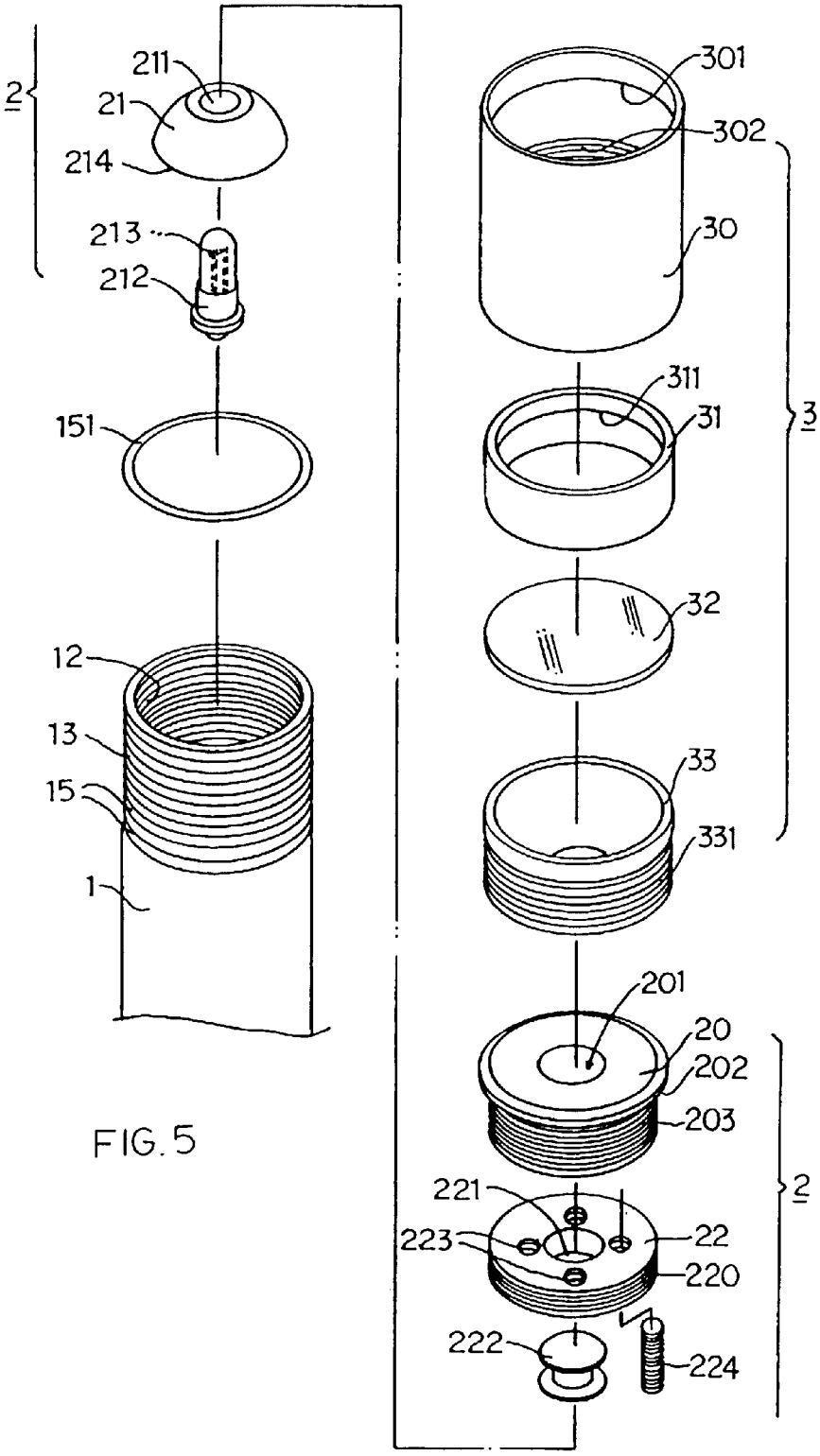
FIG. 5 is an exploded perspective view of a first embodiment of a flashlight in accordance with the present invention.
Figure 6:
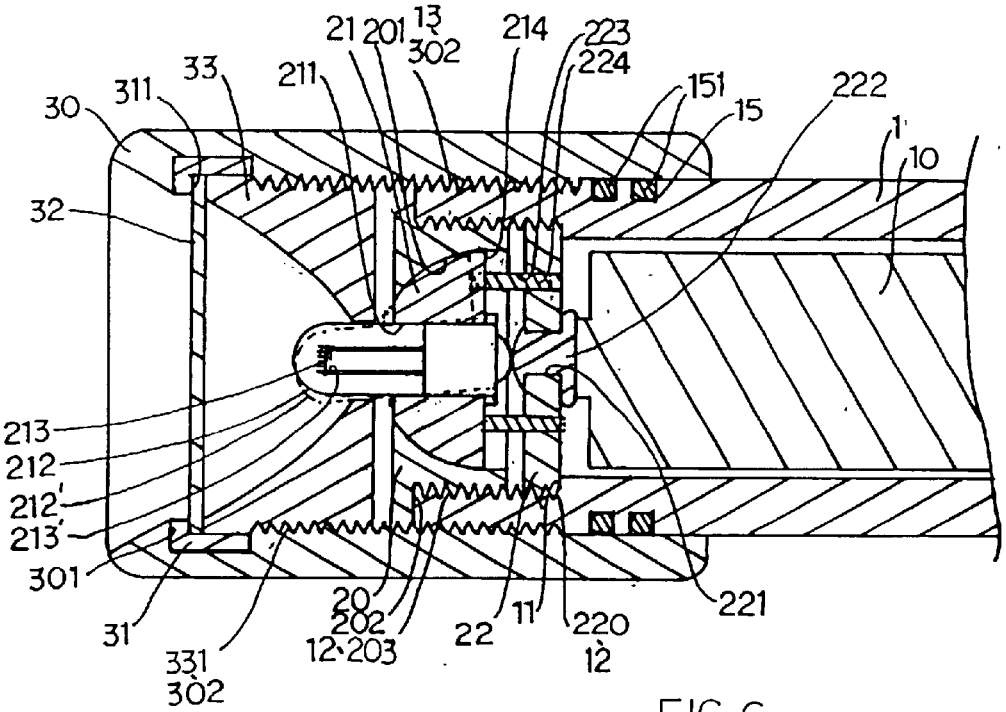
FIG. 6 is a partial sectional view of the flashlight in FIG. 5.

Referring to FIGS. 5 and 6, a first embodiment of a flashlight in accordance with the present invention generally includes a barrel 1, a lamp seat assembly 2, and a lamp shield assembly 3.

The barrel 1 is made from electrically conductive metal to form a hollow barrel for receiving a battery unit (two dry cells 10 in this embodiment) therein. A shoulder 11 is formed on a front end of an inner periphery of the barrel 1. The front end of the inner periphery of the barrel 1 further includes an inner threading 12. The front end of an outer periphery of the barrel 1 includes an outer threading 13. The outer periphery of the barrel 1 further includes an annular groove 15 defined in the front end thereof and adjacent to the outer threading 13 for receiving an O-ring 151 for preventing water from entering the flashlight.

The lamp seat assembly 2 comprises a lamp seat 20 and an insulating plate 22. The lamp seat 20 is made from electrically conductive metal. A flange 202 is formed on an end of an outer periphery of the lamp seat 20. The lamp seat 20 includes an outer diameter slightly smaller than an inner diameter of the barrel 1 such that the lamp seat 20 can be mounted into the barrel 1 with outer threading 203 on the outer periphery of the lamp seat 20 being threadedly engaged with inner threading 12 of the barrel 1 and with the flange 202 of the lamp seat 20 abutting against a front annular end face of the barrel 1, best shown in FIG. 6. The lamp seat 20 includes a central through-hole 201 with a concave wall portion for receiving a movable seat 21 that is made from electrically conductive material. The movable seat 21 includes a through-hole 211 for threadedly or tightly receiving a lamp 212.

The insulating plate 22 is substantially cylindrical and has an outer threading 220 for threading engagement with the inner threading 12 of the barrel 1. A side of the insulating plate 22 abuts against the shoulder 11 of the barrel 1 and is thus positioned. The insulating plate 22 includes a longitudinal through-hole 221 for receiving a conductive member 222 having a length slightly greater than a thickness of the insulating plate 22. The conductive member 222 has a first end electrically connected to a positive pole (not labeled) of the lamp 212 and a second end electrically connected to a positive pole of one of the dry cells 10, thereby forming a positive pole circuit. The negative pole of the lamp 212 is electrically connected to the negative pole of the other dry cell 10 through the movable seat 21, the lamp seat 20, the barrel 1, and a switch (not shown, as it is not the main feature of this embodiment), thereby forming a negative pole circuit.

A plurality of screw holes 223 are defined in the insulating plate 22 and surround the through-hole 221 of the insulating plate 22. A screw or bolt 224 is mounted in each screw hole 223. A front end of each bolt 224 can be adjusted to protrude beyond an associated screw hole 223 to a desired extent. The front end of each bolt 224 abuts against a flat rear side 214 (FIG. 6) of the movable seat 21. Thus, by means of adjusting the protruded extent of each bolt 224, the filament 213 of the lamp 212 can be adjusted in the vertical direction to locate in the focus of a reflective member 33 of the lamp shield assembly 3 (see the phantom lines and numerals 212' and 213' in FIG. 6 showing the new position of the filament 213 and the lamp 212). In other words; the position of the movable seat 21 is securely positioned in the through-hole 201 of the lamp seat 20 after adjustment in the vertical direction. It is noted that other means can be used to adjust the position of the filament 213 of the lamp 212. The user may also use his or her finger to finely adjust the lamp 212 to make the convex surface of the movable seat 21 to slide along the concave wall portion of the through-hole 201 of the lamp seat 20 until the filament 213 of the lamp 212 reaches the focus of the reflective member 33. Next, adhesive may be applied into (by means of permeation) the space between the convex outer surface of the movable seat 21 and the concave wall portion of the through-hole 201 of the lamp seat 20 to thereby bond them together.

The lamp shield assembly 3 comprises a lamp shield 30, a waterproof sleeve 31, a protective lens 32, and a reflective member 33. The lamp shield 30 is substantially a tubular member made from metal and includes a ledge 301 on an inner periphery thereof for retaining the waterproof sleeve 31 that is made from rubber. The waterproof sleeve 31 is securely mounted to the inner periphery of the lamp shield 30 and includes a ledge 311 for retaining the protective lens 32 in place. The reflective member 33 is made from metal and includes an outer threading 331 for engaging with the inner threading 302 of the lamp shield 30. The outer threading 331 of the reflective member 33 can be forced to engage with the inner threading 302 of the lamp shield 30 by means of using suitable tools to thereby cause the reflective member 33 to push the protective lens 32 to press against the waterproof sleeve 31. Two sides of the protective lens 32 are in tight and intimate contact with the ledge 301 of the lamp shield 30 that is stopped by the ledge 311 and the reflective member 33, respectively. The required pressure-tight effect and waterproof effect are thus provided. The inner threading 302 of the lamp shield 30 is threadedly engaged with the outer threading 13 of the barrel 1 to allow adjustment of the relative position between the reflective member 33 and the lamp seat 20 upon manually rotating the lamp shield assembly 3. Thus, the position of the filament 213 of the lamp 212 can be adjusted in the horizontal direction.

Figure 8:
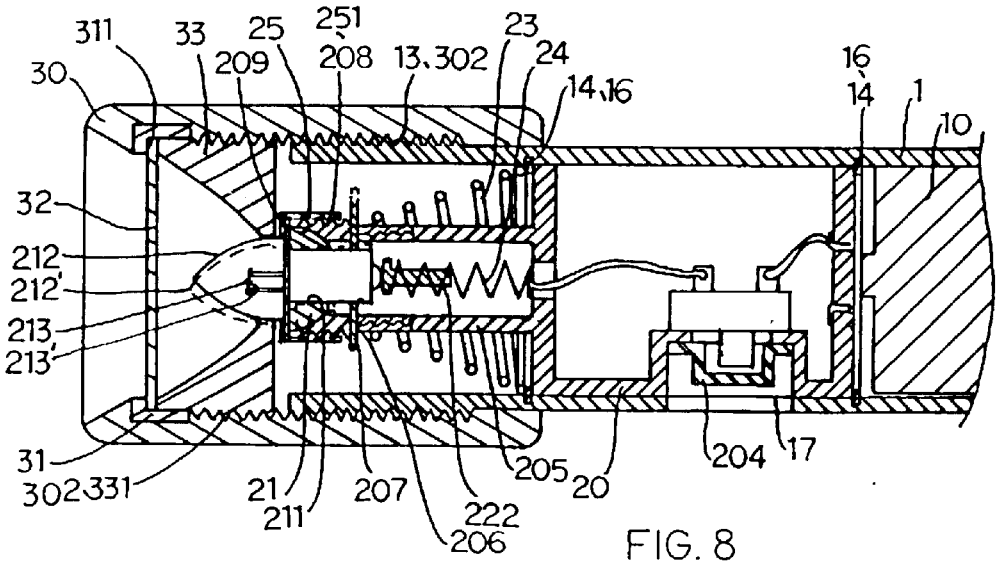
FIG. 8 is a partial sectional view of the flashlight in FIG. 7.
Figure 7:
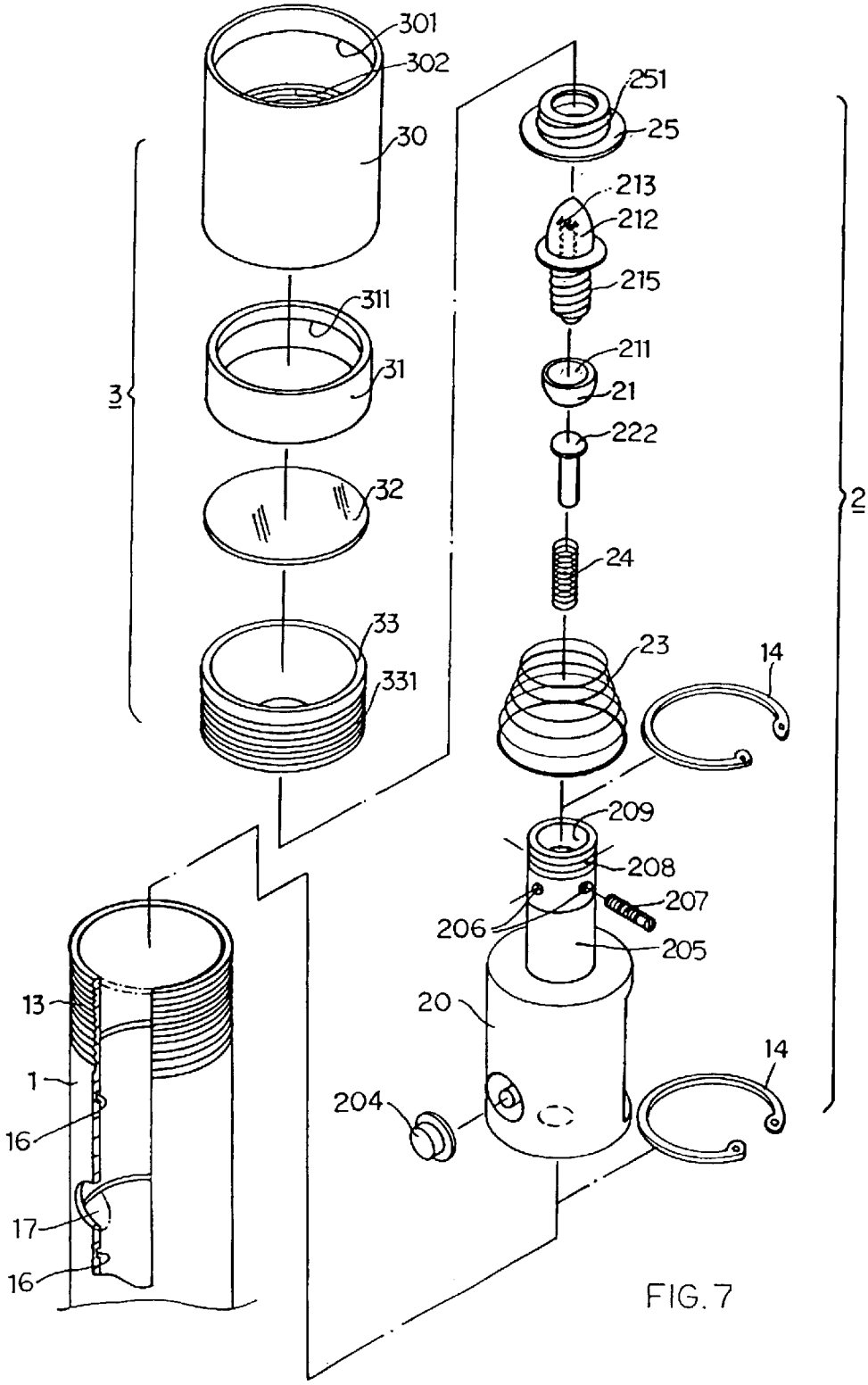
FIG. 7 is an exploded perspective view of a second embodiment of the flashlight in accordance with the present invention.

FIGS. 7 and 8 illustrate another embodiment of the flashlight in accordance with the present invention. In this embodiment, the flashlight includes a barrel 1, a lamp seat assembly 2, and a lamp shield assembly 3.

The barrel 1 is made from electrically conductive metal to form a hollow barrel for receiving a battery unit (two dry cells 10 in this embodiment) therein. A shoulder 11 is formed on a front end of an inner periphery of the barrel 1. The front end of an outer periphery of the barrel 1 includes an outer threading 13 for threading engagement with the lamp shield assembly 3. The outer periphery of the barrel 1 further includes two annular grooves 16 defined in the front end thereof and adjacent to the outer threading 13. A C-clip 14 is received in each annular groove 16 for holding a lamp seat 20 of the lamp seat assembly 2. A transverse hole 17 is defined in the barrel 1 and between the annular grooves 16. A button 204 for the lamp seat 20 extends through the transverse hole 17 for manually control of on/off of a lamp 212.

The lamp seat assembly 2 comprises a lamp seat 20, a movable seat 21, an outer conductive spring 23, and an inner conductive spring 24. The lamp seat 20 is tubular and includes a reduced section 205 on a top thereof. The inner conductive spring 24 and a conductive member 222 are mounted in the reduced section 205, wherein the conductive member 222 has an end attached to an end of the inner conductive spring 24. The other end of the conductive member 222 is connected to the positive pole of the lamp 212. The other end of the inner conductive spring 24 is connected through the button 204 to the positive pole of one of the dry cells 10, thereby forming a positive pole circuit. The outer conductive spring 23 is mounted around the reduced section 205 and includes an end connected to the negative pole of the lamp 212. The other end of the outer conductive spring 23 is connected through the barrel 1 to the negative pole of the other cell 10, thereby forming a negative pole circuit.

The front end of the reduced section 205 includes a concave wall 209 for receiving the movable seat 21 with a convex outer surface. The movable seat 21 includes a through-hole 211 for threadedly or tightly receiving a lamp 212 that is retained in place by a conductive cap 25 having an inner threading 251 threadedly engaged with an outer threading 208 on the front end of the reduced section 205 of the lamp seat 20. Below the outer threading 209 are a number of screw holes 206 each receiving a bolt 207 therein.

A front end of each bolt 207 can be adjusted to protrude beyond an associated screw hole 206 to a desired extent. The front end of each bolt 224 abuts against a periphery 215 of the lamp 212. Thus, by means of adjusting the protruded extent of each bolt 207, the filament 213 of the lamp 212 can be adjusted to locate in the focus of a reflective member 33 of the lamp shield assembly 3 (see the phantom lines and numerals 212' and 213' in FIG. 6 showing new position of the filament 213 of the lamp 212). Thus, the movable seat 21 is retained in place in the inner concave wall 209 of the lamp seat 20 after adjustment in the vertical direction. It is noted that other means can be used to adjust the position of the filament 213 of the lamp 212. The user may also use his or her finger to finely adjust the lamp 212 to make the convex outer surface of the movable seat 21 to slide along the concave wall 209 of the reduced section 205 of the lamp seat 20 until the filament 213 of the lamp 212 reaches the focus of the reflective member 33. Next, adhesive may be applied into (by means of permeation) the space between the convex outer surface of the movable seat 21 and the concave wall 209 of the through-hole 201 of the reduced section 205 to thereby bond them together.

The lamp shield assembly 3 comprises a lamp shield 30, a waterproof sleeve 31, a protective lens 32, and a reflective member 33. The lamp shield 30 is substantially a tubular member made from metal and includes a ledge 301 on an inner periphery thereof for retaining the waterproof sleeve 31 that is made from rubber. The waterproof sleeve 31 is securely mounted to the inner periphery of the lamp shield 30 and includes a ledge 311 for retaining the protective lens 32 in place. The reflective member 33 is made from metal and includes an outer threading 331 for engaging with the inner threading 302 of the lamp shield 30. The outer threading 331 of the reflective member 33 can be forced to engage with the inner threading 302 of the lamp shield 30 by means of using suitable tools to thereby cause the reflective member 33 to push the protective lens 32 to press against the waterproof sleeve 31. Two sides of the protective lens 32 are in tight and intimate contact with the ledge 301 of the lamp shield 30 that is stopped by the ledge 311 and the reflective member 33, respectively. The required pressure-tight effect and waterproof effect are thus provided. The inner threading 302 of the lamp shield 30 is threadedly engaged with the outer threading 13 of the barrel 1 to allow adjustment of the relative position between the reflective member 33 and the lamp seat 20 upon manually rotating the lamp shield assembly 3. Thus, the position of the filament 213 of the lamp 212 can be adjusted in the vertical direction.

According to the above description, it is appreciated that the lamp 212 is engaged on the movable seat 211 that has a convex outer surface for mating with the concave wall 209 of the lamp seat 20, thereby allowing adjustment of the filament 213 of the lamp 212 in the vertical direction until the filament 213 of the lamp 212 is located in the focus of the reflective member 33. As a result, the light beams emitted from the lamp 212 can travel a long distance.

The position of the reflective member 33 relative to the lamp seat 20 can be varied by means of manually turning the reflective member 33. Thus, the focus of the flashlight can be altered in the horizontal direction.

Although the invention has been explained in relation to its preferred embodiment, it is to be understood that many other possible modifications and variations can be made without departing from the scope of the invention as hereinafter claimed.

What is claimed is:

1. A flashlight comprising:

a barrel, a lamp seat assembly, and a lamp shield assembly having a reflective member;

the barrel being made from electrically conductive metal for receiving a battery unit, the barrel including an inner periphery having a front end, the front end of the inner periphery of the barrel having an inner threading, the barrel further including an outer periphery having a front end, the front end of the outer periphery of the barrel having an outer threading for threading engagement with the lamp shield assembly;

the lamp seat assembly comprising a lamp seat and a movable seat mounted in the lamp seat, the lamp seat being made from electrically conductive metal, the lamp seat including an outer threading on the outer periphery thereof for threadedly engagement with the inner threading of the barrel, the movable seat including a central through-hole for holding a lamp, the movable seat further including an outer convex surface for slidingly engaging with an inner concave wall of a through-hole of the lamp seat such that the movable seat is slidable relative to the lamp seat until a filament of the lamp is located in a focus of the reflective member of the lamp shield assembly.

2. The flashlight as claimed in claim 1, wherein adhesive is permeated into a space between the convex outer surface of the movable seat and the inner concave wall of the lamp seat for fixing the lamp after the filament of the lamp is located in the focus of the reflective member of the lamp shield assembly.

3. The flashlight as claimed in claim 1, wherein the lamp seat assembly further includes an insulating plate mounted in the lamp seat and behind the movable seat, a plurality of screw holes being defined in the insulating plate and surrounding a central through-hole of the insulating plate, each said screw hole receiving a bolt therein, a front end of each said bolt being adjustable to protrude beyond an associated one of the screw holes to a desired extent, the front end of each said bolt abutting against a flat rear side of the movable seat to thereby retain the lamp in place after the filament of the lamp is located in the focus of the reflective member of the lamp shield assembly.

4. A flashlight comprising:

a barrel, a lamp seat assembly, and a lamp shield assembly having a reflective member;

the barrel being made from electrically conductive metal for receiving a battery unit, the barrel including an inner periphery having a front end, the front end of the inner periphery of the barrel having two annular grooves each for receiving a C-clip, the barrel further including an outer periphery having a front end, the front end of the outer periphery of the barrel having an outer threading for threading engagement with the lamp shield assembly;

the lamp seat assembly comprising a lamp seat securely held in place by said C-clips and a movable seat mounted in the lamp seat, the lamp seat including a reduced section on a top thereof, the reduced section including a front end having a concave wall for slidingly receiving an outer convex surface of the movable seat, the movable seat including a central through-hole for securely holding a lamp, the movable seat being slidable relative to the lamp seat until a filament of the lamp is located in a focus of the reflective member of the lamp shield assembly.

5. The flashlight as claimed in claim 4, wherein adhesive is permeated into a space between the convex outer surface of the movable seat and the concave wall of the reduced section of the lamp seat for fixing the lamp after the filament of the lamp is located in the focus of the reflective member of the lamp shield assembly.

6. The flashlight as claimed in claim 4, wherein the reduced section of the lamp seat includes a plurality of screw holes each receiving a bolt therein, a front end of each said bolt being adjustable to protrude beyond an associated one of the screw holes to a desired extent, the front end of each said bolt abutting against a periphery of the movable seat to thereby retain the lamp in place after the filament of the lamp is located in the focus of the reflective member of the lamp shield assembly.

* * * * *